US005313737A

United States Patent [19]

Midas

[11] Patent Number: 5,313,737

[45] Date of Patent: May 24, 1994

[54] POWERED WINDOW OPERATOR DRIVE

[75] Inventor: Thomas J. Midas, Owatonna, Minn.

[73] Assignee: Truth Hardware Corporation, Owatonna, Minn.

[21] Appl. No.: 19,243

[22] Filed: Feb. 18, 1993

[51] Int. Cl.[5] ..... E05F 11/00

[52] U.S. Cl. ..... 49/324; 49/139; 49/340

[58] Field of Search ..... 49/340, 341, 342, 334, 49/346, 324, 339, 139, 140

[56] References Cited

U.S. PATENT DOCUMENTS

| | | | |
|---|---|---|---|
| 3,845,585 | 11/1974 | Cecil | 49/340 X |
| 4,143,556 | 3/1979 | Hauber | 49/324 X |
| 4,481,735 | 11/1984 | Jentoft et al. | 49/139 X |
| 4,521,993 | 6/1985 | Tacheny et al. . | |
| 4,617,758 | 10/1986 | Vetter . | |
| 4,840,075 | 6/1989 | Tucker | 49/341 X |
| 4,933,613 | 6/1990 | Berner et al. . | |
| 4,945,678 | 8/1990 | Berner et al. . | |
| 5,004,961 | 4/1991 | Berner et al. . | |
| 5,161,419 | 11/1992 | Moy et al. | 49/324 X |
| 5,203,113 | 4/1993 | Yagi | 49/340 X |

*Primary Examiner*—Philip C. Kannan

*Attorney, Agent, or Firm*—Wood, Phillips, VanSanten, Hoffman & Ertel

[57] ABSTRACT

A motorized operator drive is used with a window having a fixed frame and a movable sash, and a manually driven window operator mounted to the frame. The window operator includes an operator shaft rotatable to drive a linkage mechanism fastened to the sash to selectively move the sash relative to the frame to open or close the window. The drive comprises a housing having a motor end and an opposite nose end. A motor is mounted in the housing at the motor end and has an output shaft. A gear set is mounted in the housing including an input gear driven by the motor shaft and an output gear at the nose end. An adaptor is operatively engaged with both the output gear and the operator shaft to rotate the operator shaft in response to energization of the motor. A bracket is fixedly mounted to the window frame. A rubber grommet resiliently mounts a stud at the housing motor end to the bracket to provide isolation between the drive and the window.

16 Claims, 4 Drawing Sheets

POWERED WINDOW OPERATOR DRIVE

FIELD OF THE INVENTION

This invention relates to a window operator and, more particularly, to a motorized drive for a window operator.

BACKGROUND OF THE INVENTION

A window typically includes a fixed frame and a movable sash. The sash is mounted either for slidable movement relative to the frame or is hinged for pivotal movement, to open or close the window. One example of such a window is a casement window. Typically, a casement window is provided with a window operator to aid in manually opening and closing the window. An example of such a window operator is shown in Tucker, U.S. Pat. No. 4,840,075, owned by the assignee of the present application. Such a window operator includes a rotatable shaft driving a linkage mechanism for selectively moving the sash relative to the frame to open or close the window. A handle is secured to the shaft using a set screw for ease of operation.

In addition to the above-described window operators, various forms of window operators have been used for awning type windows in which the operator also includes a rotatable shaft. Similarly, certain skylight windows include a skylight window operator such as shown in Tacheny et al., U.S. Pat. No. 4,521,993, also owned by the assignee of the present application. Such a window operator also includes a rotatable shaft normally driven by a handle. Additionally, such a window operator can be used in connection with a double hung window in which the sash is slidably mounted in the frame, as by the window operator chain raising and lowering the sash.

Each of the above-described window operators is well suited for its desired operation. Nevertheless, with skylight windows the use of a manual operator may be problematic due to inaccessibility of the operator. To satisfy these concerns, motorized window operators have been used for skylight window operators, such as disclosed in the above-mentioned Tacheny et al. application, as well as Berner et al. U.S. Pat. No. 4,945,678, also owned by the assignee of the present application.

Having found success with motorized skylight window operators, there exists a desire to provide motorized operators for other types of windows, such as the above-mentioned casement windows, awning windows or double hung windows. In connection with such desires, it is important to consider the millions of such window operators already installed and in use for which such motorized functionality is desired.

The present invention is intended to overcome one or more of the problems set forth above in a novel and simple manner.

SUMMARY OF THE INVENTION

In accordance with the invention there is disclosed a power drive for use with a manual window operator.

Also in accordance with the invention there is disclosed a universal mount for such a drive to permit the drive to be installed on virtually any style manual window operator including a rotatable shaft.

Particularly, there is disclosed a motorized operator drive for use with a window having a fixed frame and a movable sash, and a manually driven window operator mounted to the frame. The window operator includes an operator shaft rotatable to drive a linkage mechanism fastened to the sash to selectively move the sash relative to the frame to open or close the window. The drive comprises a housing having a motor end and an opposite nose end. A motor is mounted in the housing at the motor end and has an output shaft. A gear set is mounted in the housing including an input gear driven by the motor shaft and an output gear at the nose end. An adaptor, in use, is operatively engaged with both the output gear and the operator shaft to rotate the operator shaft in response to energization of the motor. A bracket is fixedly mounted to the window frame. Means are provided for resiliently mounting the housing motor end to the bracket to provide isolation between the drive and the window.

It is a feature of the invention that the output gear includes an axial fluted bore and the adaptor comprises a generally cylindrical adaptor having radial protrusions corresponding to the flutes in the bore and being received in the fluted bore to be driven thereby and an axial bore for receiving the operator shaft.

It is another feature of the invention that the adaptor includes a set screw for securing the operator shaft in the bore and further comprising an alignment collar snap fit in the output gear fluted bore and including a fluted bore also receiving the adaptor and having a second set screw for securing the output gear to the adaptor so that the output drive is fixedly secured to the operator.

It is another feature of the invention that the bracket includes an opening and the mounting means comprises a rubber grommet received in the opening and a stud at the housing motor end received in the grommet.

It is a further feature of the invention that the bracket includes a plurality of openings and the grommet is selectively mounted in one of the bracket openings to provide universal mounting for any window operator.

In accordance with another aspect of the invention, there is provided a window operator drive which is simple and inexpensive to manufacture.

More particularly, the motorized operator drive comprises a one-piece housing having connected walls defining an inner space and a top opening providing access to the space. The housing includes first and second cradles formed integrally at a motor end and a drive opening at an opposite nose end. A plurality of gear shafts are secured in the housing and extend vertically to the top opening. A motor is seated in the housing between the cradles and has an output shaft defining a worm. An output gear includes a shaft received in the drive opening. A gear set comprising a plurality of gears is installed in the housing on selected ones of the shafts for operatively coupling the worm to the output gear. A top plate is secured to the housing at the top opening for securing the motor, the gear set and the output gear in the housing inner space in an operative engagement. An adaptor, in use, is secured to the output gear and the operator shaft to rotate the operator shaft in response to energization of the motor. Means are provided for fixedly mounting the housing motor end to the window.

It is a feature of the invention that each gear shaft is press fit into an opening in the housing.

It is another feature of the invention that each gear shaft extends above the top opening and the top plate includes an opening for each gear shaft for receiving a top end of each gear shaft.

It is another feature of the invention to provide a rubber pad disposed between the motor and the top plate.

It is a further feature of the invention that the drive opening comprises an opening through the housing wall and a cylindrical bearing press fit therein.

It is an additional feature of the invention that the gear set comprises a reduction gear set.

It is an additional feature of the invention that the top plate includes a drive opening and a cylindrical bearing that is press fit therein for receiving the output gear cylindrical shaft.

Further features and advantages of the invention will be readily apparent from the specification and from the drawing.

DETAILED DESCRIPTION OF THE INVENTION

Figure 1:
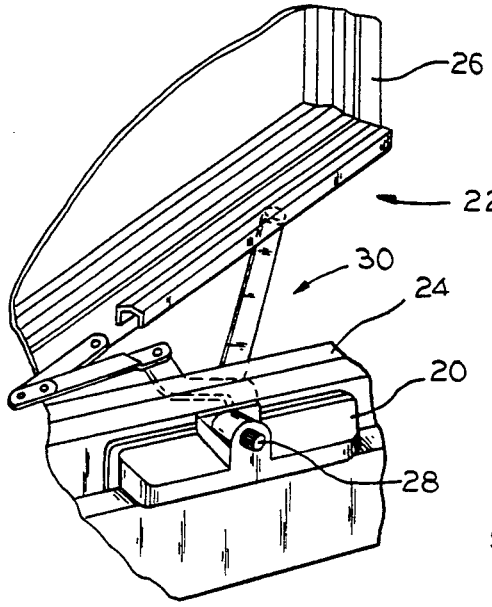
FIG.1 (PRIOR ART)
FIG. 1 is a partial perspective view of a casement window including a typical prior art manual window operator.

With reference to FIG. 1, a typical prior art window operator 20 is shown in association with a casement window 22. The casement window 22 includes a fixed frame 24 and a sash 26 supported relative to the frame 24 by hinges along a left vertical edge (not shown).

The window operator 20 may be similar to that described in Tucker, U.S. Pat. No. 4,840,075, the specification of which is hereby incorporated by reference herein. The window operator 20 includes a rotatable shaft 28 rotatable for operation of a gearing (not shown) for operating a linkage mechanism 30. The linkage mechanism is connected to the sash 26, as shown. Rotation of the operator shaft 28 produces suitable movement of the linkage mechanism 30 to pivot the sash 26 relative to the frame 24 to selectively open or close the window 22. As is apparent, rotation of the shaft 28 in one direction opens the window 22, while rotation in the opposite direction closes the window 22.

Figure 3:
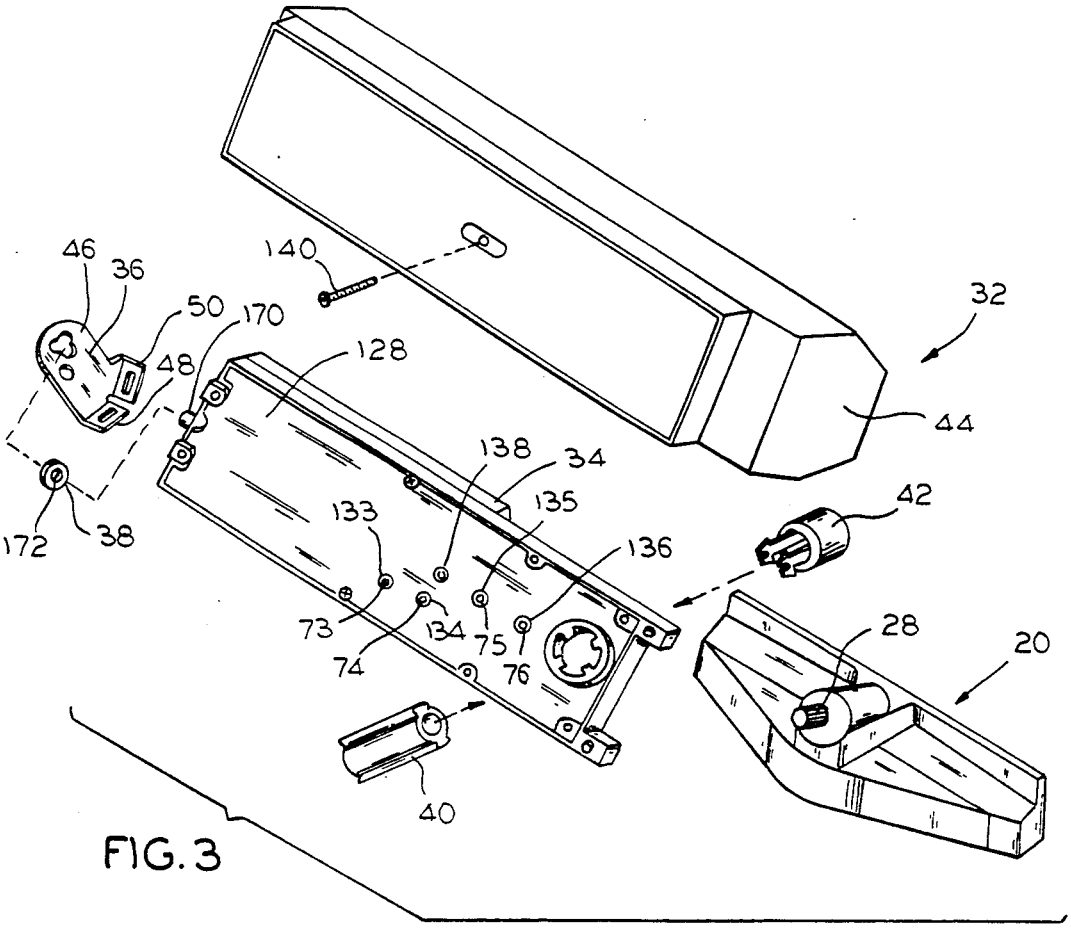
FIG. 3 is an exploded view of a motorized window operator drive of the present invention.

With reference to FIG. 3, a power operated drive 32 is shown for powering the window operator 20. The drive 32 comprises a drive assembly 34, a mounting bracket 36, a rubber grommet 38, an adaptor 40, an alignment collar 42 and a decorative cover 44.

Figure 2:
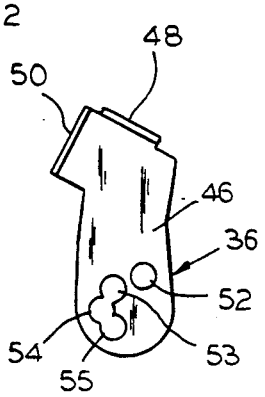
FIG. 2 is an elevation view of a bracket for the drive of the present invention.

With reference also to FIG. 2, the mounting bracket 36 comprises a generally flat plate 46 having slotted flanges 48 and 50 at one end and perpendicular to one another. The body of the plate 46 extends generally diagonally from the flanges 48 and 50. The plate 46 includes a plurality of circular openings 52, 53, 54 and 55. The mounting bracket 36 is mounted to the window frame 24, see FIG. 10, with the flanges 50 and 48 being seated on the frame 24 as shown and screws or the like (not shown) used for fastening the bracket 36 directly to the frame 24. The plural openings 52–55 are used to provide universal mounting of the drive 32. Particularly, one of the openings 52–55 is selected according to the particular window operator 20 with which the drive 32 is used. The bracket 36 provides for variable positioning of the drive assembly 34 according to the orientation of the operator shaft 28 and the distance to which it extends from the frame 24.

Figure 8:
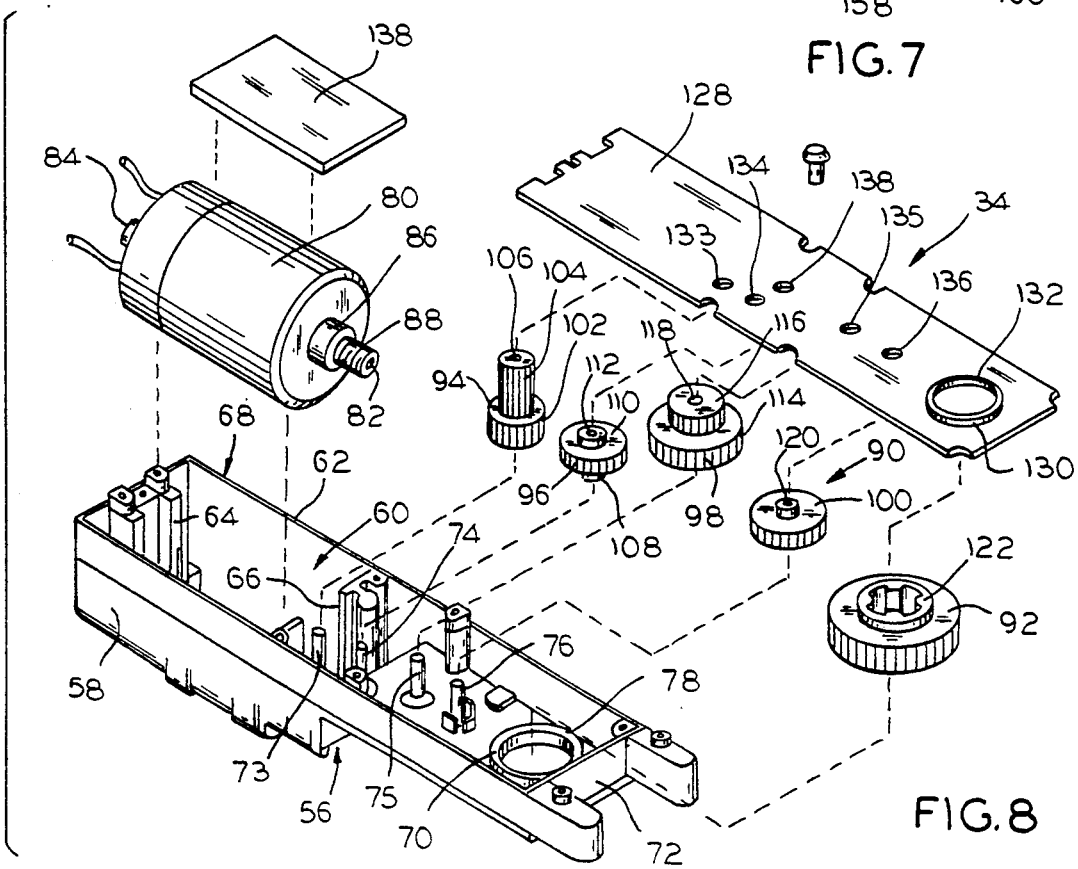
FIG. 8 is an exploded view of a drive assembly of FIG. 3.

With reference also to FIG. 8, the drive assembly 34 is illustrated in greater detail. The drive assembly 34 includes a one-piece cast housing 56. The housing 56 has connected walls 58 defining an inner space 60 and a top opening 62 providing access to the inner space 60. The housing includes first and second cradles 64 and 66 formed integrally at a motor end 68. A drive opening 70 is provided at an opposite nose end 72. As shown, the space 60 is deeper at the motor end 68 than at the nose end 72.

First, second, third and fourth gear shafts 73, 74, 75 and 76 are press fit within suitable openings (not shown) in the housing 56. Each shaft 73–76 extends vertically just above the top opening 62. The first shaft 73 being at the motor end 68 is longer than the remaining shafts 74–76. A bronze cylindrical bearing 78 is press fit within the drive opening 70.

Figure 9:
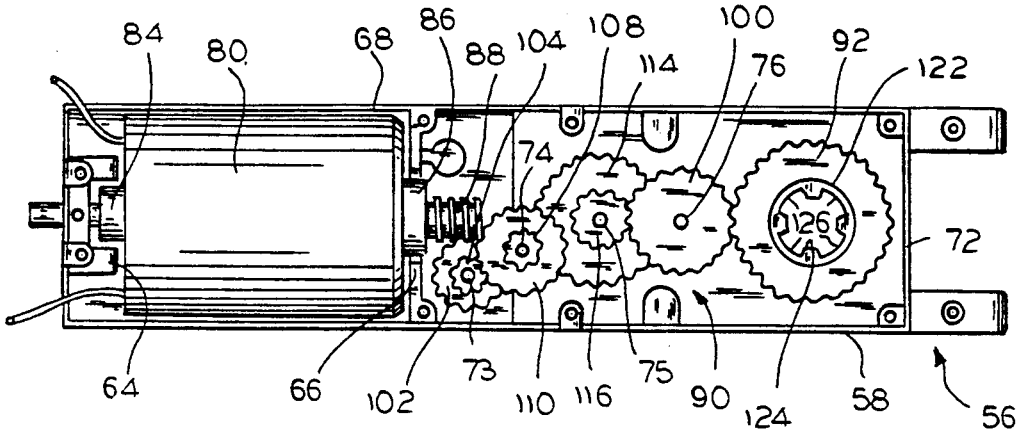
FIG. 9 is a top plan view, with the top plate removed, of the drive assembly of FIG. 3.

A motor 80 includes an output shaft 82. Coaxial with the output shaft 82 at opposite ends are respective cylindrical bosses 84 and 86. The motor 80 is inserted in the housing motor end 68 with the boss 84 resting in the first cradle 64 and the boss 86 resting in the second cradle 66, see FIG. 9. In the illustrated embodiment, the motor 80 comprises a DC permanent magnet motor.

The motor output shaft 82 includes a worm 88 press fit thereon. The worm 88 drives a gear set 90 for driving an output gear 92. The gear set 90 comprises a first gear set 94, a second gear set 96, a third gear set 98 and an idler gear 100.

The first gear set 94 includes an integral helical gear 102 and spur pinion 104. An axial throughbore 106 receives the first shaft 73 so that the helical gear mates with the worm 88, see FIG. 9. In the illustrated embodiment, the helical gear 102 includes seventeen whole teeth while the spur pinion 104 includes fourteen whole teeth.

The second gear set 96 includes an integral spur pinion 108 and spur gear 110 having a common throughbore 112. The throughbore 112 receives the second shaft 74, see FIG. 9, so that the spur gear 110 is in engagement with the first gear set spur pinion 104. The spur pinion 108 includes fourteen whole teeth, while the spur gear 110 includes thirty-two whole teeth.

The third gear set 98 includes an integral spur gear 114 and spur pinion 116 having a common throughbore 118. The throughbore 118 receives the third shaft 75, see FIG. 9, so that the spur gear 114 meshes with the second gear set spur pinion 108. The spur gear 114 includes forty-six whole teeth while the spur pinion 116 includes fourteen whole teeth. The idler gear 100 includes a throughbore 120 receiving the fourth shaft 76. The idler gear 100 meshes with both the third gear set pinion 116 and the output gear 92. The idler gear includes twenty-five whole teeth.

The output gear 92 includes forty-three whole teeth. The output gear 92 includes a cylindrical shaft 122 received in the housing drive opening in engagement with the cylindrical bearing 78. The cylindrical shaft 122 includes a fluted bore 124 defining four "flutes" or grooves 126 spaced 90° apart relative to one another.

With the above-described arrangement, energization of the motor 80 causes the worm gear 88 to drive the gear set 90 for driving the output gear 92. In order to maintain the motor 80, gear set 90, and output gear 92 in assembled relation within the housing 56, a top plate 128 is provided. The top plate 128 comprises a generally flat plate of a size and shape corresponding to the housing top opening 62. The plate 28 includes a drive opening 130 having a cylindrical bearing 132 press fit therein. The bearing 132 is generally similar to the housing bearing 78. The plate 128 also includes a plurality of circular openings 133, 134, 135 and 136, the respective positions of which correspond to the positions of the respective shafts 73–76 in the housing 56. The position of the drive opening 130 corresponds to the position of the housing drive opening 70. Prior to installing the top plate 128, a rectangular rubber pad 138 is placed atop the motor 80. The top plate 128 is then installed to cover the housing top opening 62 with the respective shafts 73–76 extending through the respective openings 133–136, see FIG. 3. An additional threaded opening 138 is centrally located in the top plate 128 for receiving a screw 140, see FIG. 3, for mounting the decorative cover 44 to the drive assembly 34.

Figure 4:
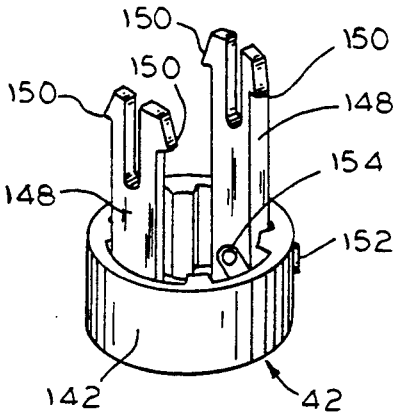
FIG. 4 is a perspective view of an alignment collar of the drive of FIG. 3.
Figure 5:
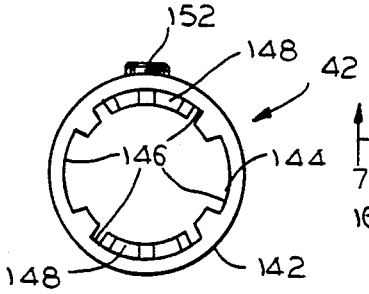
FIG. 5 is a top view of the alignment collar of FIG. 5.

With reference to FIGS. 4 and 5, the alignment collar 42 is of molded plastic construction. The alignment collar 42 includes a generally cylindrical shaft 142 of a size corresponding to the output gear cylindrical shaft 122. The shaft 142 also includes a fluted bore 144 similar to the output gear fluted bore 124 having four spaced flutes or grooves 146. However, two of the grooves 146 are substantially filled with axially extending bifurcated fingers 148 in two of the opposite grooves 146. Each bifurcated finger 148 includes locking tabs 150 at distal edges. A set screw 152 is threaded into the shaft 142 through an opening 154, see FIG. 4.

Figure 6:
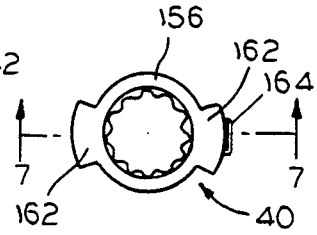
FIG. 6 is a top view of an adapter of the drive of FIG. 3.
Figure 7:
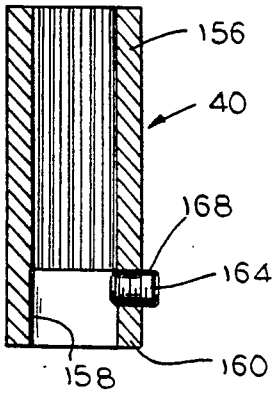
FIG. 7 is a sectional view taken along the line 7—7 of FIG. 6.

With reference to FIGS. 6 and 7, the adaptor 40 comprises an elongate cylinder 156 having a throughbore 158. The throughbore 158 is generally smooth at an operator end 160 and is otherwise splined. Extending axially along the cylinder 156 are opposite radial protrusions or "wings" 162. The protrusions 162 are of a size and shape corresponding to the alignment collar grooves 146 and the output gear grooves 126. A set screw 164 extends through a threaded opening 168 in one of the threaded grooves 162 at the operator end 160.

The particular configuration of the adaptor 40 at the operator end 160 may vary according to the configuration of the operator shaft 28 to be driven.

Figure 10:
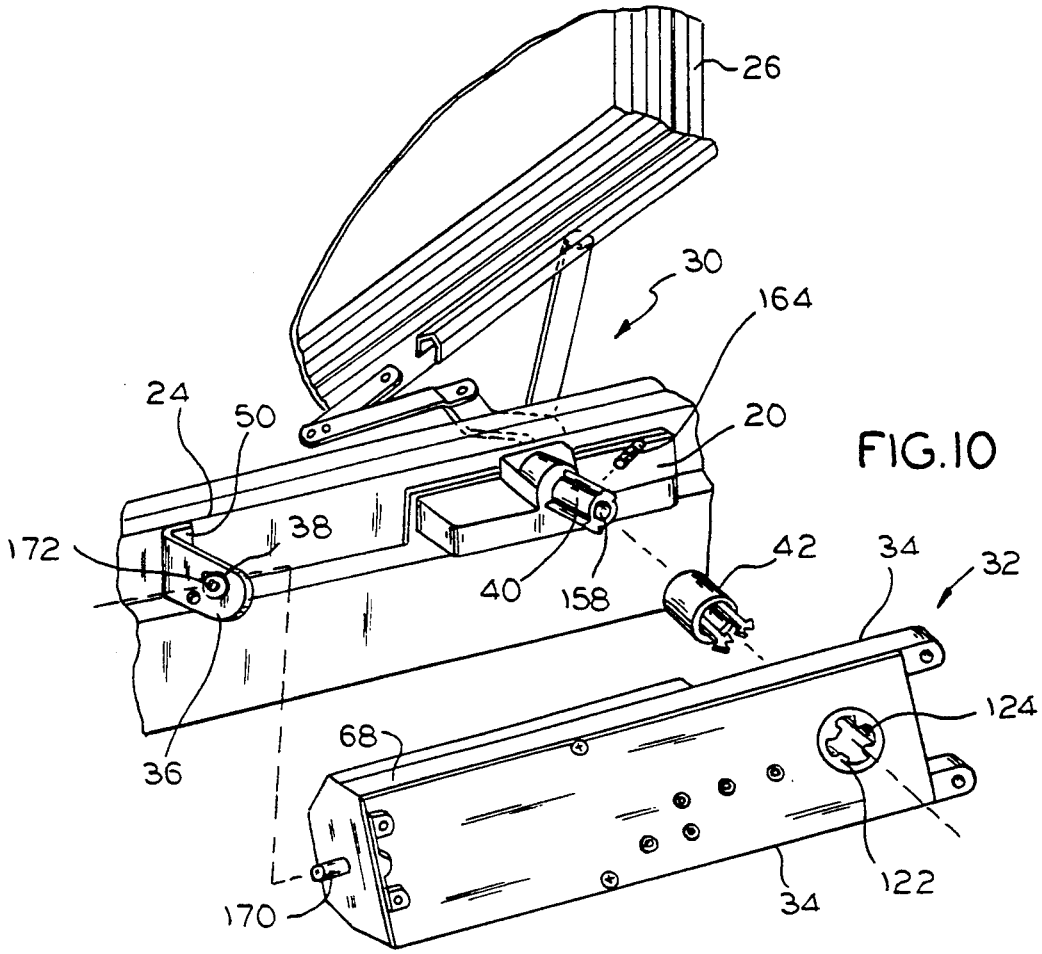
FIG. 10 is a partial, exploded perspective view, similar to FIG. 1, illustrating mounting of the drive of FIG. 3.
Figure 11:
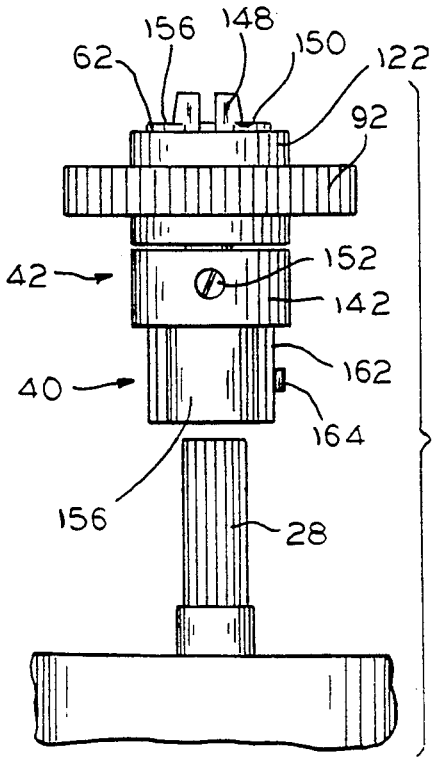
FIG. 11 is an exploded elevation view particularly illustrating connection between the output gear of the drive assembly of FIG. 3 and the shaft of the window operator.
Figure 12:
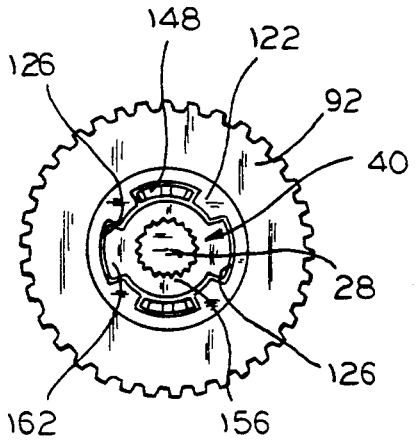
FIG. 12 is a plan view of the arrangement of FIG. 11.

Use of the drive 32 is illustrated with reference to FIGS. 10–12. Initially, the adaptor 40 is installed on the operator shaft 28 with the shaft 28 being received in the throughbore 158. The set screw 164 is threaded into the opening 168 and tightened against the operator shaft 28. The alignment collar 42 is then snap fit into the output gear cylindrical shaft bore 124 with the locking tabs 150 engaging the cylindrical shaft 122, see FIG. 11. The drive assembly 34 is then positioned to receive the adaptor 40 through the alignment collar bore 144 and output shaft bore 124. Particularly, the adaptor protrusions 162 are aligned with and received in the two grooves 146 not containing the fingers 158 and subsequently received in the corresponding grooves 126 of the output gear cylindrical shaft 122. This relationship is generally illustrated in FIG. 11 with the adaptor 40 shown spaced from the operator shaft 28.

The housing motor end 68 includes a stud 170 extending therefrom. According to the particular window operator 20, the rubber grommet 38 is inserted in one of the bracket openings 52–55. The stud 170 is then inserted through a grommet opening 172. The alignment collar is then axially positioned relative to the adaptor 40 to provide a desired, generally parallel orientation of the drive assembly 34, at which time the alignment collar set screw 152 is tightened against the adaptor 40, see FIG. 11. The resulting output assembly is particularly illustrated in FIG. 12. Indeed, the adaptor 40 is fixedly secured to the operator shaft 28 using the set screw 164. The alignment collar 42 is fixedly secured to the adaptor 40 using the set screw 152. Finally, the alignment collar 42 is fixedly secured to the output gear 92 owing to the locking relationship between the finger locking tabs 150 and the cylindrical shaft 122. Thus, rotary movement of the output gear 40 drives the operator shaft 28 through the adaptor 40. Consequently, energization of the motor 80 is translated to rotary motion of the output gear 92 and thus the operator shaft 28.

As described above, the bracket 36 including the plurality of openings 52–55 provides mounting of the operator drive 32 on a plurality of different window operators 20. The rubber grommet 38 provides isolation between the motorized drive 32 and the window 22. The grommet 38 also reduces impact transmitted to the various gears during closing of the window 22 and provides a means for operator misalignment. The post or stud 170 being fed through the rubber grommet opening 172 allows the drive assembly 34 to float, alleviating any binding that may arise from poor installation.

After assembly, the decorative cover 44 is installed over the drive assembly 34, particularly above the top plate 128, and the screw 140 is used for fastening the same. Although not shown, a decorative element may be fastened to the cover 44 for covering the screw 140. Thus, the decorative cover 44 cloaks the motorized drive assembly 34, the mounting bracket 36 and the manual operator 20.

Figure 13:
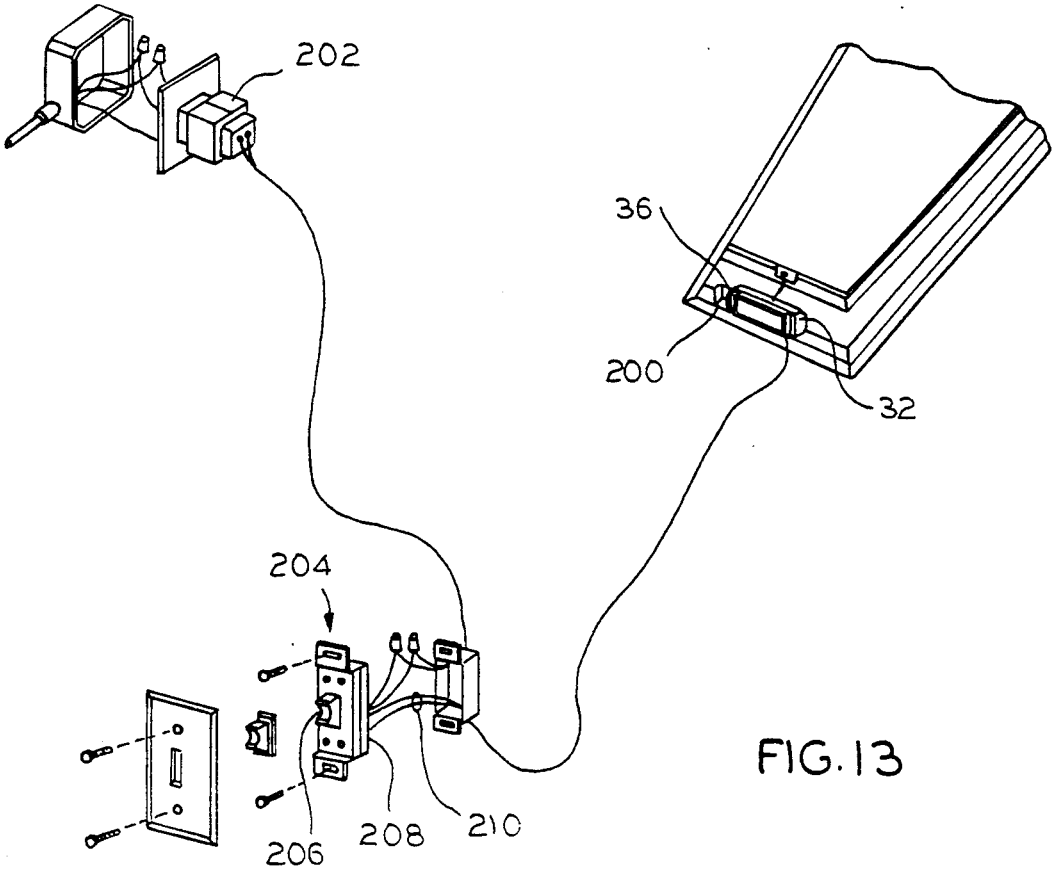
FIG. 13 is a partial perspective view illustrating the drive of FIG. 3 on a skylight window operator and showing electrical connections.

With reference to FIG. 13, the drive 32 is shown installed on a skylight window operator 200. The window operator 200 may be of the type shown in Tacheny et al., U.S. Pat. No. 4,521,993. The operator drive 32 is identical to that discussed above, the only difference being that the bracket 36 is connected to the casing for the window operator 200 instead of being connected directly to the window frame.

FIG. 13 also illustrates generally the electrical connections for powering the motor in the drive 32. A transformer 202 receives conventional 120 V AC input power and develops 24 V AC output power connected to a wall mounted switch unit 204. The wall mounted switch unit 204 includes a rocker switch 206 for commanding opening or closing of the window and a circuit board 208 operating in response to movement of the rocker switch 206 for controlling power on conductors 210 to the motor 80 in the drive 32. Particularly, the circuit board 208 includes a suitable circuit to convert AC power to DC power at a level for controlling the motor and controlling polarity of power applied to the motor to selectively open or close the window.

The drive 32 is described for use in connection with a skylight window operator and a casement window operator. In fact, the drive 32 could be used with virtually any window operator including a rotatable drive shaft.

Thus, in accordance with the invention there is disclosed an operator drive for a manually operated window operator which is both easy to assemble and install, while providing durable, noise free operation.

I claim:

1. For use with a window having a fixed frame and a movable sash, and a manually driven window operator mounted to said frame and including an operator shaft rotatable to drive a linkage mechanism fastened to said sash to selectively move the sash relative to said frame to open or close the window, a motorized operator drive comprising:

a housing having a motor end and an opposite output end;

a motor mounted in said housing at the motor end and having an output shaft;

a gear set mounted in said housing including an input gear driven by said motor shaft and an output gear at the output end;

an adapter, in use, operatively engaged with both said output gear and said operator shaft to rotate said operator shaft in response to energization of the motor;

a bracket fixedly mountable to the window frame; and means for resiliently mounting said housing motor end to said bracket to provide isolation between the drive and the window.

2. The motorized operator drive of claim 1 wherein said output gear includes an axial fluted bore and said adapter comprises a generally cylindrical adapter having radial protrusions corresponding to the flutes in said bore and being received in said fluted bore to be driven thereby and an axial bore for receiving said operator shaft.

3. The motorized operator drive of claim 2 wherein said adapter includes a set screw for securing the operator shaft in said bore and further comprising an alignment collar snap fit in said output gear fluted bore and including a fluted bore also receiving said adapter and having a second set screw for securing the output gear to said adapter so that said operator drive is fixedly secured to said operator.

4. The motorized operator drive of claim 1 wherein said bracket includes an opening and said mounting means comprises a rubber grommet received in said opening and a stud at said housing motor end received in said grommet.

5. The motorized operator drive of claim 4 wherein said bracket includes a plurality of openings and said grommet is selectively mounted in any one of said bracket openings to provide universal mounting for any window operator.

6. For use with a window having a fixed frame and a movable sash, and a manually driven window operator mounted to said frame and including an operator shaft rotatable to drive a linkage mechanism fastened to said sash to selectively move the sash relative to said frame to open or close the window, a motorized operator drive comprising:

a one piece housing having connected walls defining an inner space and a top opening providing access to said space, said housing including first and second cradles formed integrally at a motor end and a drive opening at an opposite nose end;

a plurality of gear shafts secured in said housing and extending vertically to said top opening;

a motor seated in said housing between said cradles and having an output shaft defining a worm gear;

an output gear including a shaft received in said drive opening;

a gear set comprising a plurality of gears installed in said housing on selected ones of said shafts for operatively coupling said worm gear to said output gear;

a top plate secured to said housing at said top opening for securing said motor, said gear set and said output gear in said housing inner space and in operative engagement;

an adapter, in use, secured to said output gear and said operator shaft to rotate said operator shaft in response to energization of the motor;

a bracket fixedly mountable to the window frame for mounting said housing motor end to the window.

7. The motorized operator drive of claim 6 wherein each said gear shaft press fit into an opening in said housing.

8. The motorized operator.drive of claim 6 wherein each said gear shaft extends above said top opening and said top plate includes an opening for each gear shaft for receiving a top end of each gear shaft.

9. The motorized operator drive of claim 6 further comprising a rubber pad disposed between said motor and said top plate.

10. The motorized operator drive of claim 6 wherein said drive opening comprises an opening through said housing wall and a cylindrical bearing press fit therein.

11. The motorized operator drive of claim 6 wherein said gear set comprises a reduction gear set.

12. The motorized operator drive of claim 6 wherein said top plate includes an opening and a cylindrical bearing is press fit therein for receiving said output gear cylindrical shaft.

13. The motorized operator drive of claim 6 wherein said output gear includes an axial fluted bore and said adapter comprises a generally cylindrical adapter having radial protrusions corresponding to the flutes in said bore and being received in said fluted bore to be driven thereby and an axial bore for receiving said operator shaft.

14. The motorized operator drive of claim 13 wherein said adapter includes a set screw for securing the operator shaft in said bore and further comprising an alignment collar snap fit in said output gear fluted bore and including a fluted bore also receiving said adapter and having a second set screw for securing the output gear to said adapter so that said operator drive is fixedly secured to said operator.

15. The motorized operator drive of claim 6 wherein said bracket includes an opening further comprising a rubber grommet received in said opening and said housing includes a stud at said motor end received in said grommet.

16. The motorized operator drive of claim 15 wherein said bracket includes a plurality of openings and said grommet is selectively mounted in any one of said bracket openings to provide universal mounting for any window operator.

* * * * *